US006560855B1

(12) United States Patent
Nakamura et al.

(10) Patent No.: US 6,560,855 B1
(45) Date of Patent: May 13, 2003

(54) METHOD OF MANUFACTURING THERMAL HEAD

(75) Inventors: Yuji Nakamura, Chiba (JP); Norimitsu Sambongi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/674,391

(22) PCT Filed: Mar. 13, 2000

(86) PCT No.: PCT/JP00/01517

§ 371 (c)(1),
(2), (4) Date: Jan. 29, 2001

(87) PCT Pub. No.: WO00/56550

PCT Pub. Date: Sep. 28, 2000

(30) Foreign Application Priority Data

Mar. 19, 1999 (JP) ..... 11-075989

(51) Int. Cl.[7] ..... H05B 3/00

(52) U.S. Cl. ..... 29/611; 29/621; 29/412; 29/413

(58) Field of Search ..... 29/611, 621, 412, 29/413

(56) References Cited

U.S. PATENT DOCUMENTS 4,612,433 A * 9/1986 Nagaoka et al. ..... 347/202
4,683,646 A * 8/1987 Kando et al. ..... 29/611
4,750,260 A * 6/1988 Takeno et al. ..... 29/611
5,054,190 A * 10/1991 Inoue et al. ..... 29/611
5,373,625 A * 12/1994 Shirasaki ..... 29/412
6,236,423 B1 * 5/2001 Yamaji ..... 29/611
6,243,941 B1 * 6/2001 Kashiwaya et al. ..... 29/611
6,253,447 B1 * 7/2001 Nakamura et al. ..... 216/102
6,326,990 B1 * 12/2001 Imai ..... 347/200
6,407,764 B1 * 6/2002 Susukida et al. ..... 29/611

* cited by examiner

*Primary Examiner*—Timothy V. Eley
*Assistant Examiner*—Alvin J. Grant
(74) *Attorney, Agent, or Firm*—Adams & Wilks

(57) ABSTRACT

A method of manufacturing a thermal head comprises forming a heating resistor on an insulating substrate and forming a wiring electrode on the heating resistor so that a heating portion of the wiring electrode is disposed around the heating resistor. An inorganic masking agent is disposed on a given portion of the wiring electrode, and a protective film is formed over the heating resistor, the wiring electrode and the inorganic masking agent. The protective film is then removed from the given portion of the wiring electrode together with the inorganic masking agent to selectively form the protective film on the heating resistor and on the heating portion of the wiring electrode.

20 Claims, 2 Drawing Sheets

METHOD OF MANUFACTURING THERMAL HEAD

CROSS-REFERENCE TO RELATED APPLICATIONS

This application is a U.S. national state application of copending International Application Ser. No. PCT/JP00/01517, filed Mar. 13, 2000, claiming a priority date of Mar. 19, 1999, and published in a non-English language.

BACKGROUND OF THE INVENTION

1. Field of the Invention

The present invention relates to a method of manufacturing a thermal head for use in thermal recording in a facsimile machine, a printer, or the like.

2. Background Information

Conventionally, as shown in FIGS. 2(*a*) and (*b*), a glaze layer 2 as a heat storage layer is provided on an insulating substrate 1 such as a ceramic substrate, a heater resistor material of a Ta system, a silicide system, an Ni—Cr system, or the like and an electrode material of Al, Cr—Cu, Au, or the like are formed by sputtering, deposition, or the like, a heater resistor 3, a common electrode, and a wiring electrode 4 for an individual electrode are formed by patterning in a photolithographic process, and, after that, a protective film 6 of SiO2, Ta2O5, SiAlON, Si3N4, Sic, or the like for inhibiting oxidation and for resisting wear of the heater resistor 3 is formed by sputtering, ion plating, or CVD to manufacture a thermal head.

In forming the protective film mentioned in the above, the protective film 6 has to be selectively formed in the heater resistor portion for the purpose of inhibiting oxidation and resisting wear, such that the protective film 6 does not remain at a portion 4*a* where the protective film is unnecessary such as a wire bonding portion to a driver IC for sending an image signal through the electrode to a heater resistor and the like. Several ways are conventionally known for selectively forming the protective film 6.

First, there is a way where physical masking is carried out. An example of this is shown in FIG. 2(*a*), where a metal mask 7 masks the substrate. With this method, since the metal mask 7 masks the substrate, not only can improvement of the positioning accuracy of the protective film 6 not be expected, but also its peeling off from the metal mask 7 is induced, leading also to decrease in the yield. Further, a space must be provided between the metal mask and the substrate such that the wiring electrode 4 is not damaged. There is a disadvantage that, here, the protective film 6 wraps around to the space between the metal mask 7 and the substrate, a protective film wraparound portion 6*a* is formed, and the protective film 6 remains even at the portion 4*a* where the protective film is unnecessary. In order to compensate for this point, in the step of designing, the protective film wraparound portion 6*a* is designed so as to be admitted, which is a factor that inhibits miniaturization of the substrate size, increase in the number of the thermal heads taken from one substrate, and the like.

Another way is to imbricate substrates. As shown in FIG. 2(*b*), since the substrates are imbricated, the wiring electrode 4 is damaged by contact. In order to prevent the wiring electrode 4 from being damaged, a space has to be provided between the substrates, which causes a disadvantage that the protective film 6 remains even at the portion 4*a* where the protective film is unnecessary. Further, for the purpose of imbricating the substrates, a wafer-like substrate has to be cut into long substrates. Cutting and imbricating the substrates takes time, causes increase in steps of the production process, and is a factor that increases the cost. In addition, since the substrates have to go through the production process in the cut state even at steps subsequent to the formation of the protective film 6, there is a disadvantage that the production touring is deteriorated.

Secondly, there is a way where the protective film 6 is chemically etched to selectively form the protective film 6. As the protective film 6 used in a thermal head, an inorganic ceramic film is used which is chemically and physically stable. Therefore, it is etched using a chemical of a hydrogen fluoride system. However, such a chemical has an extremely slow etching rate, which is a factor that lowers the productivity. This is true of not only etching using a chemical but also dry etching using a vapor phase method. In addition, etching using a chemical has a disadvantage that, since a metal is used as the wiring electrode 4, the etching selectivity to the protective film 6 can not be secured and even the wiring electrode 4 is etched. Therefore, this is not practical in the field of thermal heads.

As a way to solve these problems and to accommodate miniaturization of the substrate size and improvement in the productivity, selective formation of the protective film 6 using a masking agent, so-called lift-off, is known.

However, conventional selective formation of the protective film according to the lift-off is carried out using photoresist as the masking agent. In a method using photoresist, the protective film is formed at a high temperature in a high vacuum. In other words, the photoresist is exposed to the high temperature and the high vacuum. Since the photoresist is a resin, it can not withstand the conditions when the protective film is formed, and generates gas in a vacuum container. Such gas not only contaminates the inside of the vacuum container but also deteriorates the adhesion and the quality of the protective film, which may be a factor that decreases the reliability of the thermal head. Further, in case the masking agent is peeled off, since the resin is carbonized, i.e., burned out, it can not be peeled off, the masking agent remains on the wiring electrode at the portion where the protective film is unnecessary, wire bonding for connecting a driver IC for sending an image signal through the electrode to the heater resistor and the like can not be carried out, and the essential function of the thermal head is not carried out.

Further, a masking agent of a polyimide system which is more heat-resistant than such photoresist is also used. Though polyimide is heat-resistant, once it is cured, its peelability deteriorates extremely. At that time, although the amount is small the masking agent remains on the wiring electrode. If the masking agent remains, it becomes a factor that decreases the reliability in mounting and the productivity. For example, since the strength of the wire bonding for connection to a driver IC for sending an image signal through the electrode to the heater resistor and the like can not be secured, the wire bonding may be detached. To compulsorily peel it off, a polar solvent such as NMP for dissolving the polyimide has to be used. The use of such a polar solvent adversely affects the operator and the working environment. In addition, there is a problem that, since the consciousness of protecting the global environment has been raised recently, a strong chemical can not be used unconditionally.

Accordingly, an object of the present invention is, in order to solve the conventional problems mentioned in the above, to obtain a method of manufacturing a thermal head which can, by using inorganic paste as the masking agent, accommodate miniaturization of the substrate and an increased number of the thermal heads taken from one substrate, and which can selectively form a protective film with high positioning accuracy of the protective film, with high adhesion of the protective film, and with high reliability.

SUMMARY OF THE INVENTION

According to the present invention, in a method of manufacturing a thermal head having on an insulating substrate at least a heater resistor, a wiring electrode for supplying electric power to the heater resistor, and a protective film for covering the heater and the wiring electrode on the periphery thereof, at least the heater resistor and the wiring electrode for supplying electric power to the heater resistor are formed on the insulating substrate, a portion where the protective film is unnecessary of the wiring electrode where a driver IC for sending an image signal through the electrode to the heater resistor and the thermal head are connected by wire bonding is masked using inorganic paste, the protective film is formed over the whole surface, and then, the protective film of the portion where the protective film is unnecessary is peeled off together with the inorganic paste to selectively form the protective film on the heater and a heat generating portion of the wiring electrode on the periphery thereof In a thermal head constituted as in the above, since the portion where the protective film is unnecessary is masked using the inorganic paste and the masking agent for forming the protective film contains no resin therein, the heat resistance is extremely high, and gas is not generated in a vacuum container at a high temperature in a high vacuum. Therefore, the inside of the vacuum container is not contaminated, and high adhesion of the film and high reliability of the film can be obtained. In addition, since its heat resistance is extremely high and it contains no resin component, there is no phenomenon such as carbonization and burnout, which facilitates its peeling off. Therefore, the masking agent does not remain on the wiring electrode, and thus, the strength of the wire bonding is improved. Further, since the masking agent can be used at an arbitrary position, the protective film can be formed selectively, and thus, the substrate size can be made smaller, the number of the thermal heads taken from one substrate increases, and the productivity is improved.

DETAILED DESCRIPTION OF THE PREFERRED EMBODIMENT

Figure 1A:
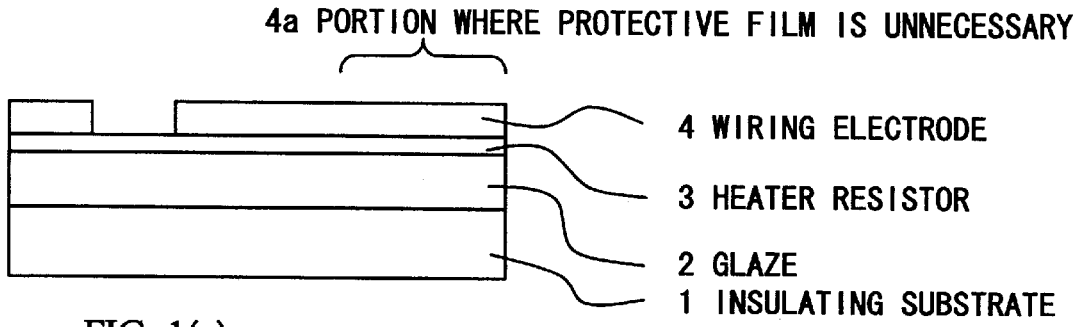
FIGS. 1(*a*)–1(*d*) are explanatory views illustrating a method of manufacturing a thermal head according to the present invention.
Figure 1B:
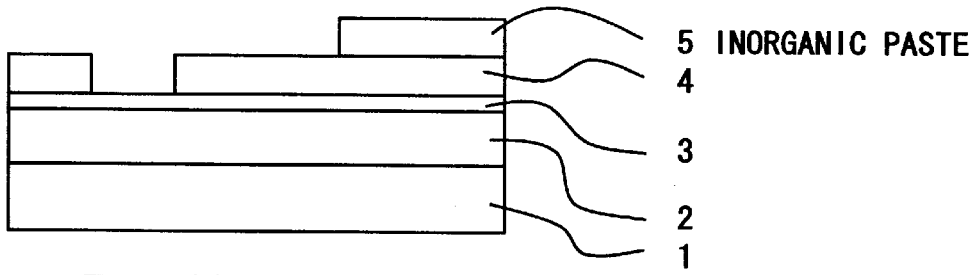
Figure 1C:
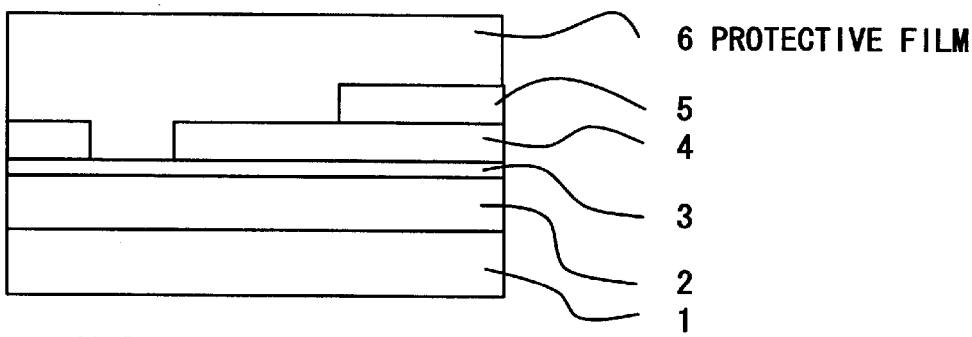
Figure 1D:
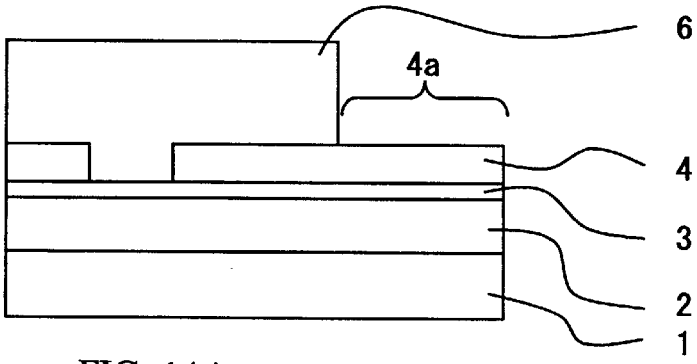
Figure 2:
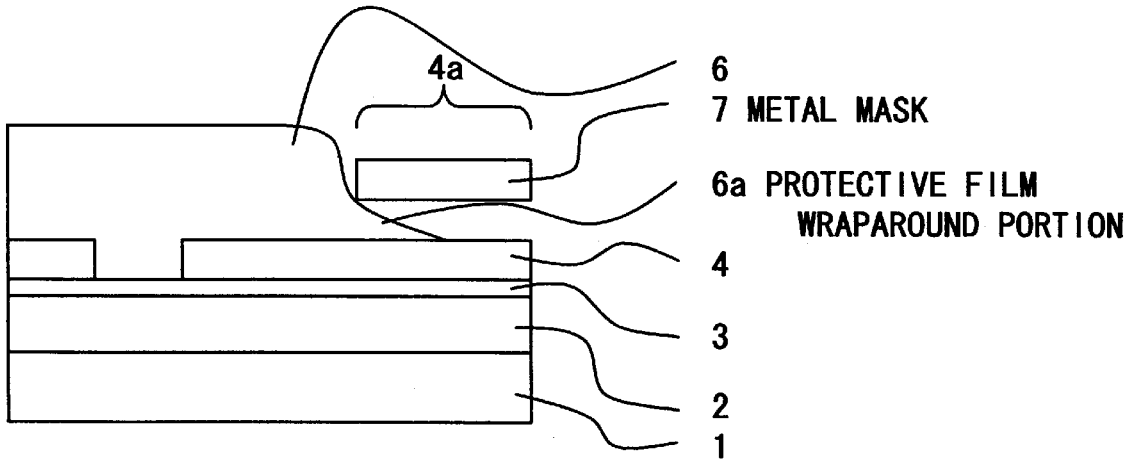
FIGS. 2(*a*)and 2(*b*) are explanatory views illustrating a conventional method of manufacturing a thermal head.
Figure 2:
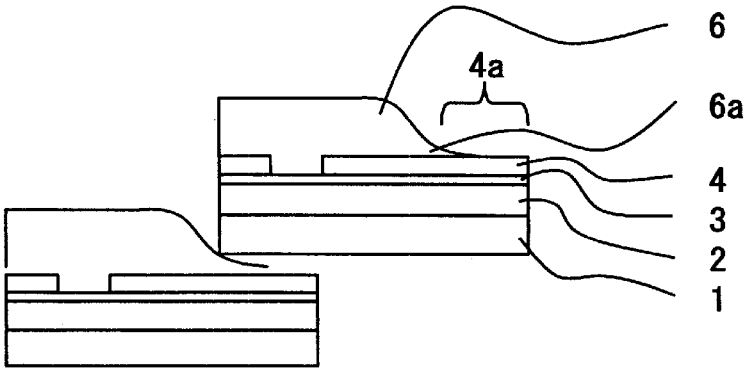

An embodiment of the present invention is described in the following with reference to the drawings. FIG. 1 is a figure illustrating the process of a method of manufacturing a thermal head according to the present invention. As shown in FIG. 1(*a*), a glaze 2 is formed for heat storage on an insulating substrate 1 made of alumina ceramics or the like. Then, a film as a heater resistor material of Ta—N, Ta—$SiO_2$, or the like, the main component of which is Ta, is formed by sputtering to a thickness of about 0.1 $\mu$m. Thereafter, a wiring electrode 4 is formed by photolithography. Next, a film as an electrode material for supplying electric power to the heater resistor 3 of Al, Al—Si, Al—Si, Cu, or the like, the main component of which Al, is formed by sputtering or the like to a thickness of about 1–2 $\mu$m. Thereafter, a wiring electrode 4 is formed by photolithography. The wiring electrode 4 is provided with a portion 4*a* where a protective film is unnecessary, which is for later connection to a driver IC for sending an image signal through the electrode to the heater resistor or the like by wire bonding or the like.

Then, in FIG. 1(*b*), an inorganic paste 5 is formed of pure water, ceramic powder the main component of which is alumina, silica, or the like, and bentonite as a binding component. They are mixed into a paste, and used as the inorganic paste 5. The particle size of the ceramic powder used here is about 1–5 $\mu$m. If the particle size of the ceramic powder is larger than 5 $\mu$m, inconvenience such as lowered printability is sometimes caused, and thus, it is not practical. Bentonite as the binding component is a layered silicate containing moisture the main component of which is montmorillonite which is a clay mineral, and has the characteristics of being swelled by water and having an increased viscosity. Therefore, it is most suitable for making an inorganic matter into paste for printing. In addition, since no organic matter is contained, the heat resistance is excellent and no gas is generated even at a high temperature in a high vacuum.

Then, the mixed inorganic paste 5 is applied to the portion 4*a* where the protective film is unnecessary of the wiring electrode 4. As the method of applying it, screen printing is most suitable. Since screen printing has high productivity and high printing accuracy, and can form various patterns by changing the shape of the screen mask, it is effective in selectively applying the inorganic paste 5 to the portion 4*a* where the protective film is unnecessary of the wiring electrode 4. The inorganic paste 5 is printed at the thickness of about 10–30 $\mu$m by screen printing. Since the film thickness to be printed depends on the film thickness of a protective film 6 to be formed later, it is required to be at least twice as thick as the film thickness of the protective film 6. If the film thickness is equivalent to or is smaller than the film thickness of the protective film, the peelability which is necessary in a subsequent step deteriorates.

Other applying methods include application using a dispenser or the like, offset printing using a roller, and flexography. The applying method can be selected so as to match the shape into which the paste is applied.

After that, by drying the inorganic paste 5 at 150 ° C. or higher, moisture in it evaporates. Evaporation of moisture makes the inorganic paste 5 cure to mask the portion 4*a* where the protective film is unnecessary of the wiring electrode 4.

Then, as shown in FIG. 1(*c*), for the purpose of inhibiting oxidation and resisting wear, a film which is a mixture of Si3N4 and SiO2 or the like is formed by sputtering or the like at the thickness of about 3–6 $\mu$m over the whole surface of the substrate so as to cover all of the heater resistor 3, the wiring electrode 4, and the inorganic paste 5, and the protective film 6 is formed over the whole surface.

After that, as shown in FIG. 1(*d*), the substrate with the protective film 6 formed over the whole surface thereof is soaked in water such as pure water. This makes the inorganic paste 5 swell, and the protective film 6 formed at the portion 4*a* where the protective film is unnecessary peels off together with the inorganic paste 5. Here, as a means for enhancing the peelability and the productivity, or as a means for removing the residue of the inorganic paste 5 on the wiring electrode 4 to enhance the strength of the wire bonding and to obtain reliability, ultrasonic cleaning is effective. In particular, a low frequency band such as 28–45 kHz is effective. Further, as a way of finishing cleaning, cleaning using a high frequency band of 100 kHz or higher is more effective. Other than this, a way of running water cleaning with pressurized water such as waterjet or the like is also effective.

As a result, the protective film 6 at the portion 4*a* where the protective film is unnecessary is removed, and the protective film 6 is selectively formed on the heater resistor 3 and a heat generating portion of the wiring electrode 4 on the periphery thereof.

INDUSTRIAL APPLICABILITY

As described in the above, according to the present invention, since the protective film of a thermal head is selectively formed using inorganic paste, the substrate size is made smaller, the number of the thermal heads taken from one substrate increases, and the productivity is improved. Further, since selective formation can be carried out, a complicated protective film having a through hole or a multilayer wiring electrode constitution can be formed, which improves the degree of freedom in designing a thermal head.

Further, since the inorganic paste does not generate gas even in a vacuum container, high reliability of the protective film can be obtained and the life of the thermal head can be made longer. Still further, since the inside of the vacuum container is not contaminated, the maintenance cycle of the system can be improved.

Still further, since the protective film can be easily formed selectively without using any chemical or the like, there is an effect that the operator and the working environment are not affected, and the natural environment of the earth is not at all affected.

What is claimed is:

1. A method of manufacturing a thermal head, comprising the steps of: forming on an insulating substrate a heater resistor and a wiring electrode for supplying electric power to the heater resistor, the wiring electrode having a connection portion for connection to a driver integrated circuit for sending an image signal to the heater resistor through the wiring electrode; disposing an inorganic paste on the connection portion of the wiring electrode; forming a protective film over the entire surface of the heater resistor and the wiring electrode; and removing the protective film from the connection portion of the wiring electrode together with the inorganic paste to selectively form the protective film on the heater resistor and a heat generating portion of the wiring electrode around the heater resistor.

2. A method of manufacturing a thermal head as claimed in claim 1; wherein the inorganic paste has a main component comprised of ceramic powder of alumina.

3. A method of manufacturing a thermal head as claimed in claim 1; wherein the inorganic paste has a binding component comprised of bentonite, the binding component having a main component comprised of montmorillonite.

4. A method of manufacturing a thermal head as claimed in claim 1; wherein the inorganic paste has a main component comprised of silica powder.

5. A method of manufacturing a thermal head, comprising the steps of: forming a heating resistor on an insulating substrate; forming a wiring electrode on the heating resistor so that a heating portion of the wiring electrode is disposed around the heating resistor; disposing an inorganic masking agent on a given portion of the wiring electrode; forming a protective film over the heating resistor, the wiring electrode and the inorganic masking agent; and removing the protective film from the given portion of the wiring electrode together with the inorganic masking agent to selectively form the protective film on the heating resistor and on the heating portion of the wiring electrode.

6. A method according to claim 5; wherein the inorganic masking agent comprises an inorganic paste.

7. A method according to claim 6; wherein the inorganic paste has a main component comprised of alumina powder.

8. A method according to claim 6; wherein the inorganic paste has a main component comprised of silica powder.

9. A method according to claim 6; wherein the inorganic paste has a binding component comprised of bentonite.

10. A method according to claim 9; wherein the bentonite has a main component comprised of montmorillonite.

11. A method according to claim 6; wherein the inorganic paste comprises ceramic powder and a binding component.

12. A method according to claim 11; wherein the ceramic powder has a particle size of 1–5 $\mu$m.

13. A method according to claim 11; wherein the binding component comprises a layered silicate containing moisture.

14. A method according to claim 5; wherein the disposing step comprises disposing the inorganic masking agent by screen printing.

15. A method according to claim 14; wherein the disposing step further comprises printing the inorganic masking agent to a thickness of about 10–30 $\mu$m.

16. A method according to claim 15; wherein the inorganic masking agent comprises an inorganic paste.

17. A method of manufacturing a thermal head, comprising the steps of: providing an insulating substrate; forming a heater resistor over the insulating substrate; forming a wiring electrode on the heater resistor, the wiring electrode having a connection portion; disposing an inorganic paste on the connection portion of the wiring electrode; forming a protective film over the entire surface.of the heater resistor and the wiring electrode including the connection portion of the wiring electrode; and removing the protective film from the connection portion of the wiring electrode together with the inorganic paste to selectively form the protective film on the heater resistor and the wiring electrode.

18. A method according to claim 17; wherein the inorganic paste comprises ceramic powder and a binding component.

19. A method according to claim 18; wherein the ceramic powder has a particle size of 1–5 $\mu$m; and wherein the binding component comprises a layered silicate containing moisture.

20. A method according to claim 17; wherein the disposing step comprises disposing the inorganic paste by screen printing the inorganic paste to a thickness of about 10–30 $\mu$m.

* * * * *